United States Patent [19]

Blatt et al.

[11] 3,949,650

[45] Apr. 13, 1976

[54] EQUAL AREA DISPLACEMENT HYDRAULIC CYLINDER

[76] Inventors: Leland F. Blatt, Grosse Pointe Shores, Mich. 48236; Gordon J. Fox, Clinton Township, Mich. 49236

[22] Filed: Jan. 16, 1975

[21] Appl. No.: 541,601

[52] U.S. Cl. ..... 92/108; 92/168

[51] Int. Cl.[2] ..... F01B 31/04

[58] Field of Search ..... 92/108, 107, 168

[56] References Cited

UNITED STATES PATENTS

| | | | |
|---|---|---|---|
| 2,664,859 | 1/1954 | Green | 92/108 |
| 3,200,596 | 8/1965 | Olson et al. | 92/108 |
| 3,710,689 | 1/1973 | Henderson | 92/108 |

FOREIGN PATENTS OR APPLICATIONS

| | | | |
|---|---|---|---|
| 1,197,976 | 7/1970 | United Kingdom | 92/108 |

*Primary Examiner*—Paul E. Maslousky

*Attorney, Agent, or Firm*—Cullen, Settle, Sloman & Cantor

[57] ABSTRACT

An equal area displacement hydraulic cylinder includes a hollow reciprocal piston rod and piston, and between said cylinder and rod, a first chamber communicating with a first port for retracting the piston rod. A rod end closes said piston rod and includes an attachment device. A hollow tube extends within the piston rod and is anchored at one end to the cylinder and terminates in a second port. A stationary piston is mounted on the other end of said tube. Said tube defines a second chamber communicating with the rod end and second piston for advancing the piston rod when said second port is pressurized. The working area of the reciprocal piston is the same as the working area of the rod end, whereby equal rod force is applied to the reciprocal piston rod in either direction.

1 Claim, 2 Drawing Figures

EQUAL AREA DISPLACEMENT HYDRAULIC CYLINDER

BACKGROUND OF THE INVENTION

In conventional types of hydraulic cylinders wherein ports are provided within the heads of the cylinder at opposite ends, the working area on one side of the piston is less than the working area on the other side due to the diameter of the piston rod with the result that unequal forces are applied to the piston from its opposite sides and, thus, unequal rod forces depending upon the direction of movement of the piston and piston rod.

BRIEF DESCRIPTION OF THE INVENTION

It is an object of the present invention to provide an improved equal area displacement hydraulic cylinder wherein the working area to which pressure fluid is supplied for retracting or advancing the piston rod is the same with the result that there will be equal rod force in both directions.

This and other objects will be seen from the following specification and claims in conjunction with the appended drawing.

Figure 1:
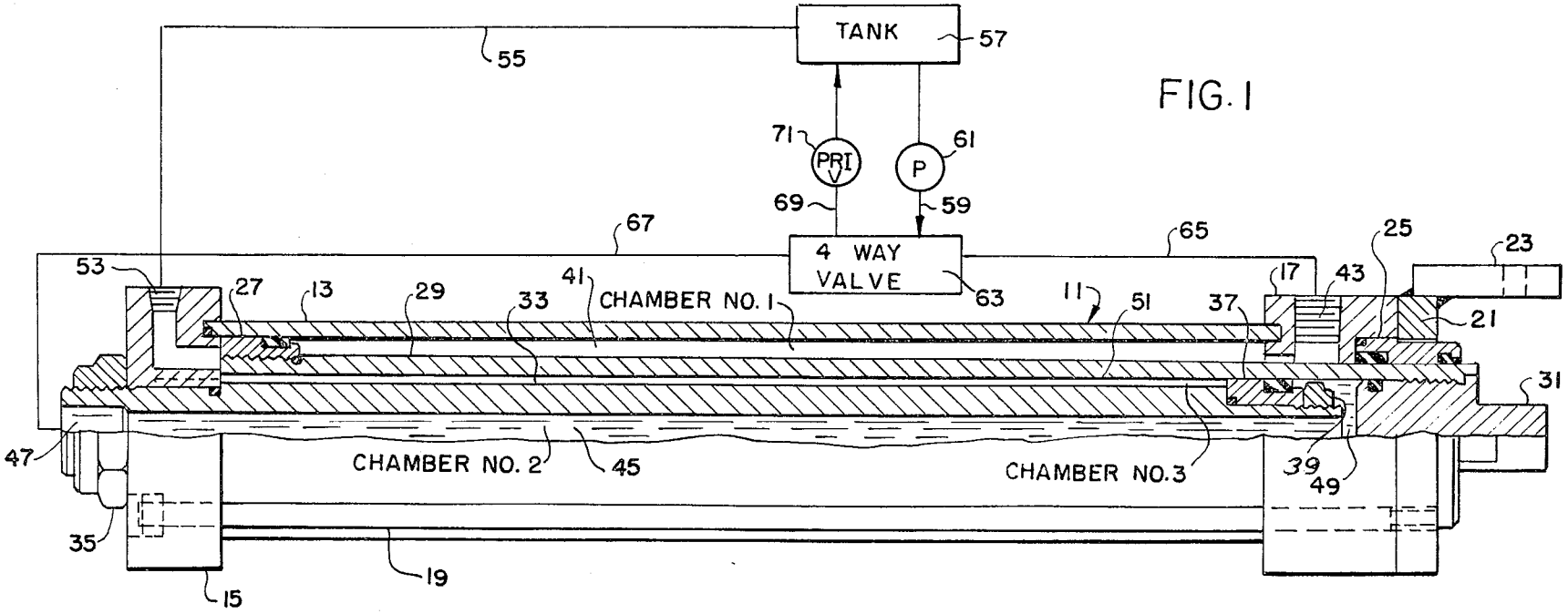
FIG. 1 is a longitudinal section of the equal area displacement hydraulic cylinder.
Figure 2:
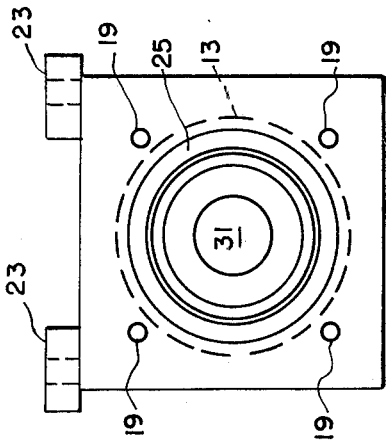
FIG. 2 is an end elevational view thereof.

It will be understood that the above drawing illustrates merely a preferred embodiment of the invention, and that other embodiments are contemplated within the scope of the claims hereafter set forth.

DETAILED DESCRIPTION OF THE INVENTION

Referring to the drawing, the equal area displacement hydraulic cylinder 11 is designed for use with a hydraulic or hydrostatic closed loop circuit where equal fluid delivers equal rod force in both directions of the cylinder actuation. The present cylinder includes elongated outer tube 13 and sealed over the ends thereof, blind end cap 15 and rod end cap 17, secured and assembled by the tie rods 19 used in conjunction with the retainer assembly plate 21.

The retainer assembly includes a pair of spaced apertured forwardly extending end plates 23 to provide a means for anchoring and supporting the cylinder in a normal position of use. Apertured rod gland 25 is nested and retained within the rod end cap and end plate anchor 21 and suitably sealed with respect to said rod end cap and reciprocal hollow piston rod 29.

Said piston rod is spaced within tube 13 and at one end is anchored and sealed to piston 27, shown in retracted position, FIG. 1, in registry with and sealed with respect to the bore of said tube 13. The opposite end of the hollow piston rod extends through and projects outwardly of said gland and at its outer end is closed by the rod end 31 which is projected thereinto and suitably sealed therein.

The outer portion of the rod end has a cylindrical attachment means adapted for connection to a device for effecting reciprocal movements thereof, on corresponding reciprocal movements of the hollow piston rod.

Stationary elongated innertube 33 is spaced from and extends into the hollow piston rod substantially along its length, bears against blind end cap 15, is suitably sealed with respect thereto and is secured to said cap by lock nut 35.

A stationary piston 37 is mounted over the inner end of the stationary tube and secured thereto by a lock nut 39. Said piston is sealed with respect to the tube and similarly sealed with respect to the interior bore of the hollow piston rod which is adapted to move relatively thereto.

The elongated space between tube 13 and the reciprocal piston rod 29 defines a first chamber 41 along the length of said tube and which terminates in a first port 43 in the rod end cap 17, FIG. 1.

The hollow stationary tube 33 defines upon its bore a second chamber 45, which terminates in a second port 47. The inner end of the second chamber communicates with the fourth chamber 49, between the far end of the stationary piston 37 and rod end 31.

Third chamber 51, FIG. 1 is defined between the hollow piston rod 29 and stationary tube 33. Said chamber extends to the blind end cap and communicates with a vent 53 which communicates with atmosphere, or through conduit 55 to fluid storage tank 57. Should any pressure fluid, such as oil, escape past the exterior of the stationary piston 37 and enter chamber 51, said fluid will flow through vent port 53 and will be returned to tank 57.

The venting of chamber 51 provides a means to permit the escape of any accumulated air, so as not to hinder reciprocal movements of the piston and its piston rod with respect to the stationary piston rod.

As shown schematically in FIG. 1, the fluid storage tank 57 is connected to a fluid pressure pump 61 in a conduit 59 for delivery of pressure fluid to the four-way valve 63. In normal neutral position of said valve, said pressure fluid is delivered via conduit 65 to port 43 for delivery into chamber 41, for pressurizing piston 27 and effecting retraction thereof to the position shown in the drawing. Excess fluid in chamber 45 is simultaneously returned via port 47 through conduit 67 back to the four-way valve and through exhaust conduit 69 and pressure relieve valve 71 back to the tank 57.

In operation, in order to advance the piston and piston rod from the position shown in FIG. 1, the four-way valve is moved to a control position from its normal position so as to change the flow of pressure fluid to deliver same through conduit 67 to port 47. This pressure fluid communicates with chamber 45 and extends to the chamber 49 between rod end 31 and the stationary piston 37. This causes forward longitudinal movement of the hollow piston rod and its rod end outwardly from the position shown in FIG. 1. At the same time, fluid in chamber 41 is returned via port 43 and conduit 65 back to the four-way valve for exhausting through conduit 69 and pressure relief valve 71 back to the tank 57.

The working area of the reciprocal piston 27 is the same as the working area of the rod end 31 adjacent the chamber 49.

The volumetric capacity of the chambers 41 and 49 are the same with the result that regardless of whether the pressure fluid is directed to port 43 or port 47, the working force upon the piston rod in either direction will be the same.

The present cylinder is ideal for use with hydrostatic or hydraulic closed loop circuits where equal rod force is required in both directions.

This equal force is achieved because for retraction of the piston 27, pressure fluid is acting directly thereon.

However, in order to advance the piston and piston rod, pressure fluid acts upon the blind end of the said hollow piston rod and with respect to the stationary piston 37.

Having described our invention, reference should now be had to the following claims.

We claim:

1. In an equal area displacement hydraulic cylinder having an outer tube; blind end and rod end caps receiving and secured to opposite ends of said tube; and a gland in said rod end cap;

a hollow piston rod within said tube along its length projecting through said gland, and defining with said tube a first chamber;

a rod end secured within the outer end of said piston rod adapted for connection to a device for effecting reciprocal movements thereof;

a reciprocal piston in said first chamber secured to said piston rod;

a stationary open-ended inner tube within said piston rod along its length and at one end anchored to said blind end cap and extending therethrough, terminating in a first port; said port communicating with a second chamber in said inner tube;

said stationary tube being spaced from the wall of said piston rod, defining a third chamber;

a stationary piston upon the other end of said stationary tube engageable with the bore of the piston rod and said closing off third chamber;

said second chamber communicating with a fourth chamber upon the far side of said stationary piston, closed by said rod end;

there being a second port in said rod end cap communicating with said first chamber; whereby on pressurizing said second port, said movable piston and piston rod are retracted; alternately pressurizing said first port and second chamber, advancing said piston rod with respect to the stationary piston;

the effective working area of the piston in the first chamber being equal to the effective working area of the rod end closing the fourth chamber, whereby equal rod force is delivered to said reciprocal piston rod in both directions; forward movement of the reciprocal piston and piston rod within said first chamber causing relative movement of said piston rod with respect to the stationary piston, said third chamber being vented through said blind end cap;

a retainer assembly including an apertured retainer plate secured upon said rod end cap receiving said gland and rod end;

a pair of spaced apertured anchor plates secured to and projecting forwardly of said retainer plate; and the volumetric capacity of the first and fourth chambers when extended being equal.

* * * * *